US010807691B2

(12) United States Patent
Huan

(10) Patent No.: US 10,807,691 B2
(45) Date of Patent: Oct. 20, 2020

(54) IMPULSIVE MARINE THRUSTER AND POSITIVE DISPLACEMENT PUMP

(71) Applicant: Jianchun Huan, Centreville, VA (US)

(72) Inventor: Jianchun Huan, Centreville, VA (US)

(73) Assignee: Jianchun James C. Huan, Centreville, VA (US)

( * ) Notice: Subject to any disclaimer, the term of this patent is extended or adjusted under 35 U.S.C. 154(b) by 245 days.

(21) Appl. No.: 15/994,821

(22) Filed: May 31, 2018

(65) Prior Publication Data

US 2018/0346083 A1 Dec. 6, 2018

(51) Int. Cl.

| | |
|---|---|
| ***B63H 1/32*** | (2006.01) |
| ***B63H 11/08*** | (2006.01) |
| ***B63H 11/06*** | (2006.01) |
| *F04B 19/22* | (2006.01) |

(52) U.S. Cl.

CPC ..... *B63H 11/08* (2013.01); *B63H 11/06* (2013.01); *B63H 2011/081* (2013.01); *F04B 19/22* (2013.01)

(58) Field of Classification Search

CPC ..... B63H 11/06; B63H 1/32; B63H 11/04; F04B 19/22

See application file for complete search history.

(56) References Cited

U.S. PATENT DOCUMENTS 2,203,010 A * 6/1940 Diamand ..... B63H 11/12 60/221
3,677,217 A * 7/1972 Takimoto ..... B63H 1/32 440/19
3,850,195 A * 11/1974 Olsson ..... F16K 17/34 137/503
3,971,330 A * 7/1976 French ..... B63H 11/06 440/23

FOREIGN PATENT DOCUMENTS

GB 190809860 A * 9/1908 ..... B63H 11/06

* cited by examiner

*Primary Examiner* — Andrew Polay
(74) *Attorney, Agent, or Firm* — Richard Eldredge; Eldredge Law Firm

(57) ABSTRACT

A marine thruster includes a cylinder with a front opening and a rear opening; radial baffles positioned within an interior of the cylinder to separate the interior into equally divided water chambers; pistons positioned within a corresponding one of the equally divided water chambers; and an inner-ring rotary valve engaged with the cylinder to allow for side intake of water and the separation of each of the equally divided water chambers into a dry section and a wet section by pistons; the pistons engage with a power source, the power source providing axial reciprocating motion; and the pistons push water through the equally divided water chambers.

11 Claims, 7 Drawing Sheets

IMPULSIVE MARINE THRUSTER AND POSITIVE DISPLACEMENT PUMP

BACKGROUND

1. Field of the Invention

The invention belongs to a novel hydrodynamic device. Specifically, the device is an impulsive marine thruster and a positive displacement pump of great capacity.

2. Description of Related Art

Propeller or impeller-driven water jets are commonly used for marine vessel propulsion. Both devices rely on the spin of blades in water to speed up the axial speed of water for thrust. However, the spin of blades in water also inevitably causes a swirl of water, or the rotational speed of water. The rotational speed of water does not contribute to thrust, but instead creates a waste of energy. Moreover, the highly rotational speed of water is also the source of blade surface cavitation and water noise. Further, propeller and impeller-driven water jets are hardly able to maintain a linear relation between the thrust power and the input power in their entire operational range. Because of this, when their working condition shifts away from the design point, their efficiency is greatly reduced.

WO/2014/065855 patent application announced a Side-Intake Piston Water Jet Propulsor. It proposed using side intake of water in reference to discharging water in axial direction of a cylinder. By using side intake of water, a piston becomes a barrier to separate the cylinder into a dry compartment and a wet compartment any time as it moves in the cylinder, and the dry compartment maintains an atmospheric or ambient pressure condition. As a result, the piston confronts air resistance instead of water resistance during its recovering cycles, which is a main characteristic of the propulsor.

The current application proposes a new design to achieve this same concept. The key component is an invention of a novel inner-ring rotary valve. The new design makes the system much more simplified and optimized.

This application offers an impulsive marine thruster and a positive displacement pump of great capacity that employs a plurality of pistons having impulsive movement to eject water out of a cylinder to generate thrust or pump water.

The technical solution adopted by the present invention includes: a cylinder body with both front and rear openings, two sets of impulsive water jet mechanisms (being composed of a plurality of pistons), and an inner-ring rotary valve, wherein: the circular cross section of the cylinder is equally divided by radial baffles to form multiple water chambers that extend through the cylinder.

In the present application, the impulsive water jet mechanism includes a set of parallel ball-screw piston units, and every ball-screw piston unit is assembled by attaching the first end of ball-screw to the back end of the piston; the pistons are set in the water chambers of the cylinder; the ball-screw is connected to the power device; the ball-screw piston unit is driven by the power device to make axial reciprocating motion; the ball-screw piston units of the two sets of impulsive water jet mechanism are arranged in the respective water chambers at intervals; the inner-ring rotary valve is arranged at the end of the stroke of the piston at the rear end of the cylinder.

In the axial direction of the inner-ring rotary valve, there are blockage plates and openings set inside the valve to block the associated water chambers or open the associated water chambers to discharge water, on the circumferential wall of the inner-ring rotary valve, side openings are made. These openings together with the remaining wall will open and close the associated side openings of the water chambers as the valve rotates by a servo motor actuator. More specifically, the valve of the preferred embodiment has three blockages, thereby leaving three opening from a front of the valve. On the side of the valve, are also three openings and three blockages (as shown in FIGS. 4 and 5), this specific configuration allows for the pistons to separate wet and dry compartments.

The position and design of the inner-ring rotary valve makes the piston always separate the cylinder into a wet and a dry compartment during its movement. The dry compartment is connected and open to the inside of a marine vessel or the power mechanism of a water pump. Because of the presence of the dry compartment, the piston energy consumption in recovering cycles is expected to be small.

In the preferred embodiment, the reciprocating motions of the two sets of pistons maintain a phase difference of 180 degrees with each other, so as to achieve the purpose of continuous water intake and discharge.

In the preferred embodiment, the circular cross-section of the cylinder is divided into at least two equal parts.

In the preferred embodiment, the rear end of said valve is jointed with a nozzle.

In the preferred embodiment, a grid shell for flow conditioning is also included. The shell is configured to provide a sleeve style attachment on the outer side of the inner-ring rotary valve, and is connected with the cylinder and the nozzle by screws or similar devices. The flow conditioning grids on the grid shell are configured to just cover the corresponding blockage surface and the side water intake openings of said valve.

In the preferred embodiment, said valve is driven by a servo motor to rotate, the servo motor is housed in the space of the hub of said cylinder, and a cap is installed on the rear end of the hub of said valve to prevent water from entering into the hub.

The present invention also provides a positive displacement pump of great capacity. For this purpose, the system is fixed on an installation foundation and includes said cylinder, said two sets of impulsive water jet mechanisms (each having a plurality of pistons) and said valve mentioned above, in addition the nozzle exit is shaped to be a flange to connect to a water outlet pipe, and a donut-inlet envelops the side intake openings of said valve to conduct inlet flow.

In the preferred embodiment, said donut-inlet is a donut-shaped shell jointed with an inlet tube. The donut shell envelops the side intake openings of said valve and is in watertight fixed on the outer surface of said cylinder and said nozzle. The inlet tube connects to water source being pumped.

Compared with the prior art, the present invention utilizes pistons in piston-cylinder sets to eject water in the cylinders from a nozzle exit and therefore generate needed thrust for a marine vessel to advance. It avoids the energy loss caused by the rotation of the propeller, and therefore improves the propulsion efficiency. In addition, using pistons to eject water out of cylinders for thrust or pressure head rise belongs to a positive displacement pump, which makes the system possess linear performance characteristics.

Through coordinating the rotation of the unique inner-ring rotary valve and piston's reciprocating movements, one set of pistons doing discharge strokes eject water out of the nozzle while the other sets of pistons doing recovering strokes refill water into the cylinders through the side intake openings, and thus completes a hydrodynamic cycle for a continuous thrust generation or pressure head rise. A servo motor is housed inside the space of the hub of the cylinder to rotate said valve for open and close of the side intake openings of one or the other set of the impulsive water jet mechanisms; a grid shell for flow conditioning that covers on the outside of the inner-ring rotary valve can not only stabilize inlet flow, but also prevent large debris from entering the inside of the water chambers; the inside of the cylinder body is divided into several water chambers by radial baffles, and each water chamber is equipped with a piston and ball-screw set; the contact sliding surface between the piston and water chamber has a watertight sealing design to prevent water from gross leakage into the inside of marine vessel or the power system of a pump.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
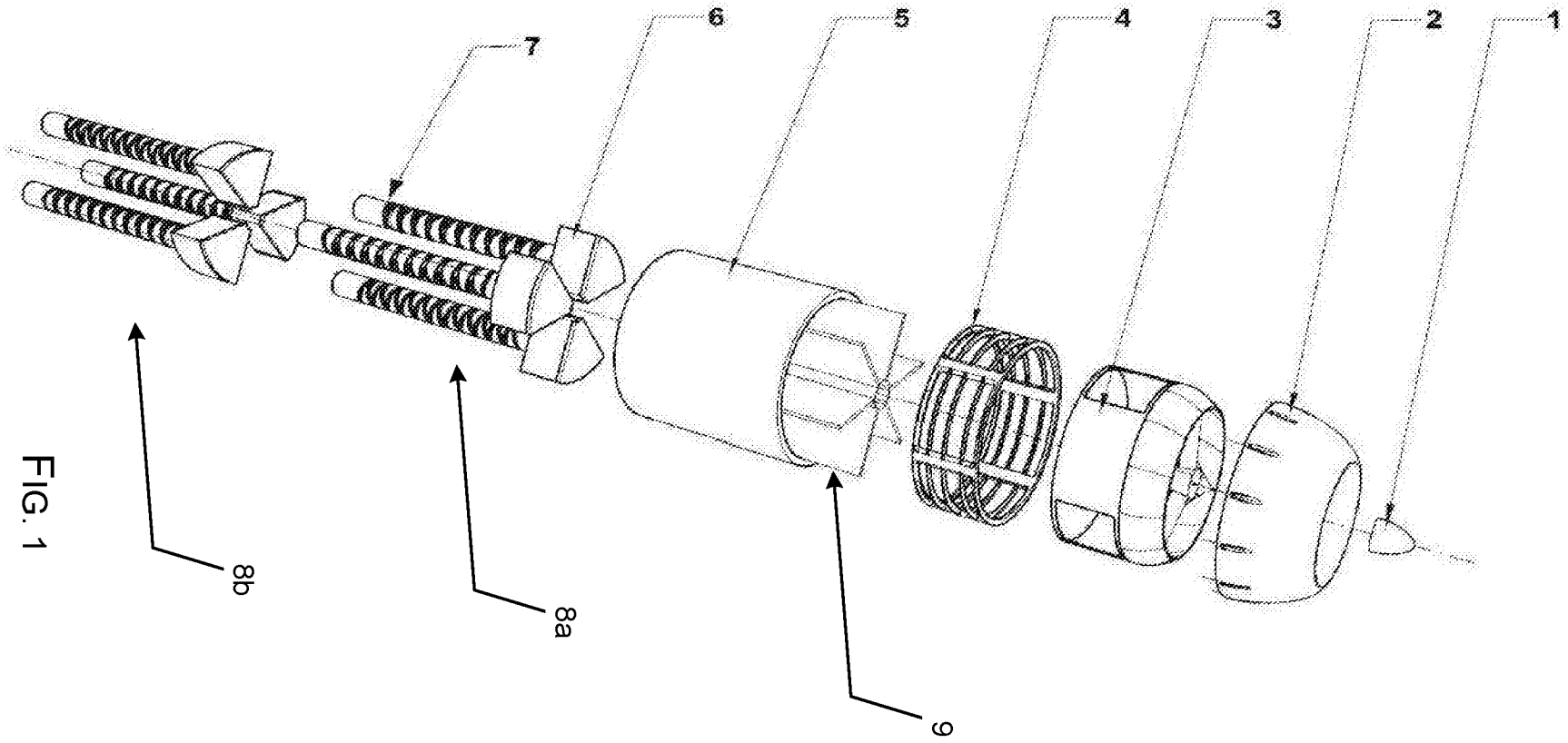
FIG. 1 is an exploded view of a marine thruster apparatus in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
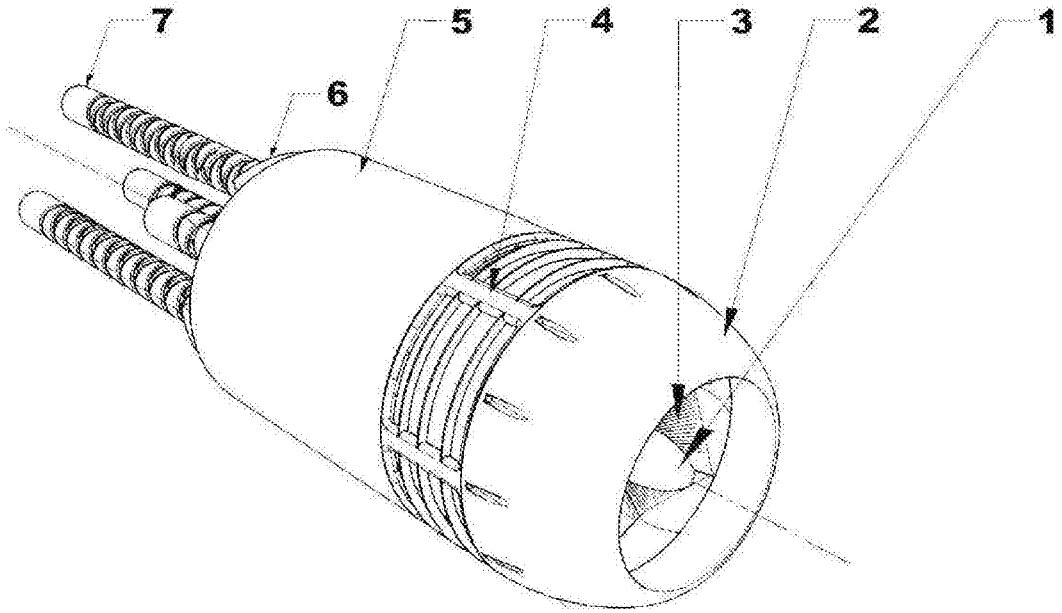
FIG. 2 is an assembled view of the marine thruster apparatus of FIG. 1.
Figure 3:
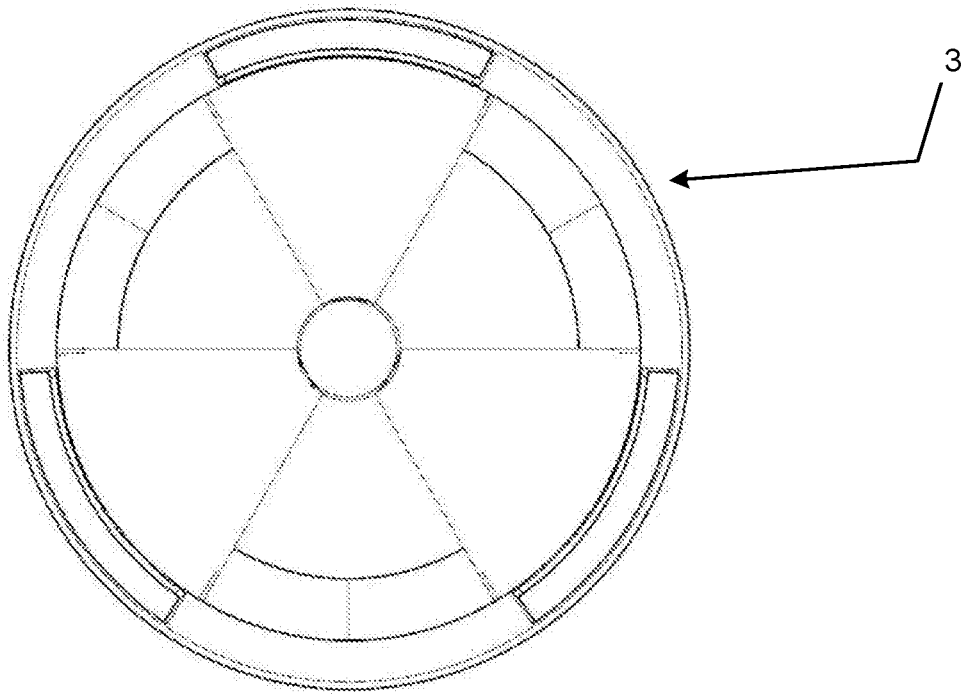
FIG. 3 is a front view of an inner ring rotary valve of FIG. 1.
Figure 4:
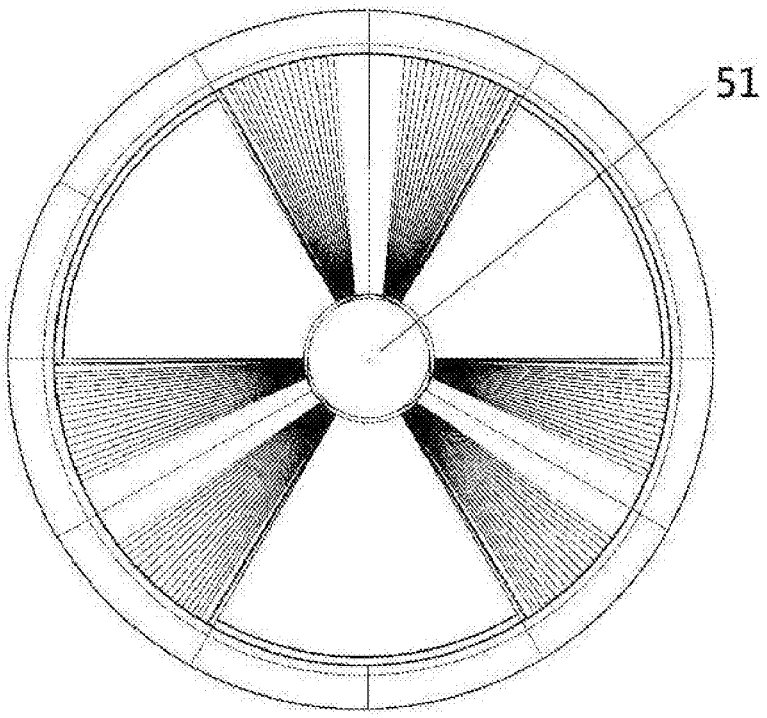
FIG. 4 is a rear view of the inner ring rotary valve of FIG. 1.

The embodiment of the present invention is shown through FIGS. 1 to 7 as a marine vessel thruster. The marine vessel thruster includes a cylinder body 5 penetrated being open from both the front and rear, two sets of impulsive water jet mechanisms 8*a*, 8*b*, an inner-ring rotary valve 3 and a nozzle 2. As shown in FIG. 2, in the circular cross-section of the cylinder body 5, the cylinder body 5 is divided into multiple water chambers by radial baffles 9, which penetrate to the front end of the cylinder body 5 and extend out of the rear end of the cylinder body 5; in the present embodiment, the cross-section of cylinder body 5 is divided into six equal parts, resulting in six water chambers in fan-shape columns. The front part of the cylinder body 5 is connected with and open to the interior of the ship, and the rear part of the cylinder body with the radial baffles 9 extended out is inserted into the ring shell of an inner-ring rotary valve 3 and a nozzle 2 joins the rear part of said valve.

In FIGS. 3-6, an arrangement of openings and blockages of the inner-ring rotary valve are shown. In the preferred embodiment, a plurality of valve axial openings 31 extending into the inner-ring rotary valve 3 are align with the fan-shape water chambers made by the radial babbles 9 and as the pistons 7 in said water chambers are making discharge strokes, water is ejected through the nozzle exit to generate thrust and advance the marine vessel. In order to for a stable water jet at the nozzle exit, the number of equal divisions in a general cylinder body 5 for water chambers should not be less than four. As shown, each piston 6 includes a ball-screw attached to a head and each piston is configured to engage with one of the plurality of equally divided water chambers.

In this embodiment, each set 8*a* and 8*b* of impulsive water jet mechanisms includes three ball-screw piston units placed aligned with the axis of the cylinder body 5. Said ball-screw piston group is formed by connecting the ball-screw 7 to the dry face of the piston 6; and the other face of the piston 6 is wet as said piston settles in the water chamber; the front part of the ball-screw 7 is connected with a motor (not shown in the figure). A motor gear system drives the ball-screws and make piston do reciprocating movements. In this embodiment, the two sets ball-screw piston units that form two sets of impulsive water jet mechanisms are alternately arranged in the six water chambers in the cylinder body 5.

The inner-ring rotary valve 3 is placed and riding on the extended radial baffles 9 in the rear part of the cylinder body 5. Referring to FIG. 3 to FIG. 6, in the front part of the inner-ring rotary valve, there are three valve side openings 34 equally distributed along the circumference of the cylindrical wall. With respect to each opening on the cylindrical wall, the axial direction inside the valve are made impermeable by three valve axial blockages 32. On the other hand, with respect to the impermeable part of the cylindrical wall or valve side blockages 33, the axial direction inside the valve is made open or valve axial openings 31 for the discharging water to pass through.

Referring to FIG. 2, this embodiment further includes a grid shell 4 for flow conditioning. Said grid shell 4 is sleeved on the outside of the inner ring rotary valve 3 and is fixed in between of said cylinder body and said nozzle with screws or the like. The grids on said grid shell are laid on the valve side openings 34. The grids help stabilizing the intake flow and also prevent large debris from entering the interior of said water chambers.

Referring to FIGS. 1 and 2, this embodiment also includes a nozzle 2, and the nozzle 2 is disposed outside of the rear part of the inner-ring rotary valve 3.

Figure 5:
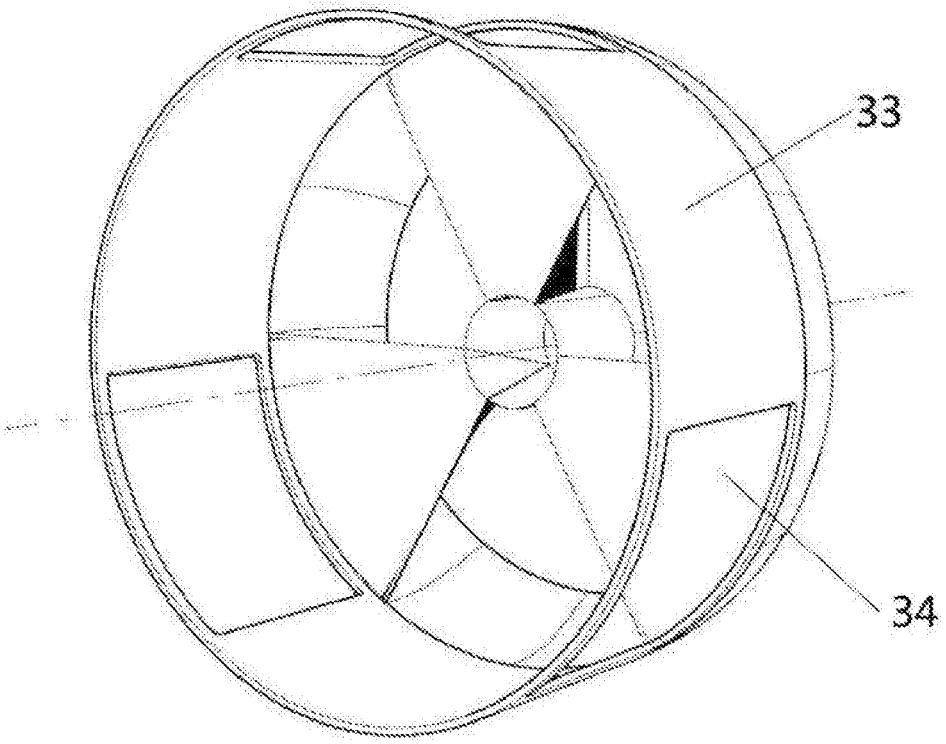
FIG. 5 is a perspective view of the inner ring rotary valve from the front.
Figure 6:
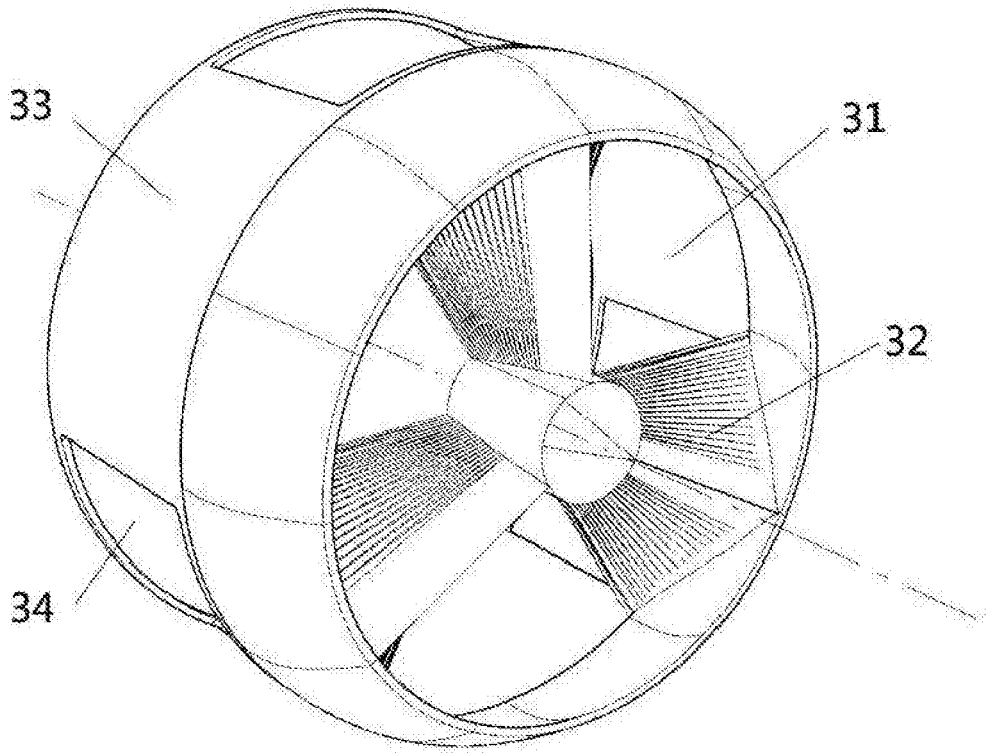
FIG. 6 is a perspective view of the inner ring rotary valve from the rear.

As shown in FIG. 5, the so-called Side-Intake of water uses the three valve side openings 34 to intake water into the water chambers of the cylinder body, 5. The principle feature of the Side-Intake concept is to separate the water chambers to be a dry and a wet compartment by the pistons at any moment as they move. The dry compartments are open to the inside of a marine vessel or the power system of a pump. Because of the existence of the dry compartment, the pistons confront air instead of water during their recovering cycles, which expect to save energy.

In operation, the inner-ring rotary valve 3 driven by a servo motor rotates 60 degree a time rendering the three valve side openings, 34 open the side inlets of one set of the three water chambers, while the three valve side blockages, 33 close the side inlets of the other set of the three water chambers. After the valve actuated, one set of three pistons associated to the side inlets fully opened does the recovering cycle for water intake meanwhile the other set of three pistons associated to the side inlets fully closed does the stroke to discharge water out of the nozzle for thrust generation. After this half cycle finishes, the valve actuates again and the two sets of pistons switch their stroke mode, i.e., one from intake to discharge and the other from discharge to intake, and continue their strokes until finish. That completes one cycle and after that the process repeats. In general, the two sets of pistons work in a half cycle or 180 degree phase difference and the inner-ring rotary valve rotates 60 degree in each actuation.

Figure 7:
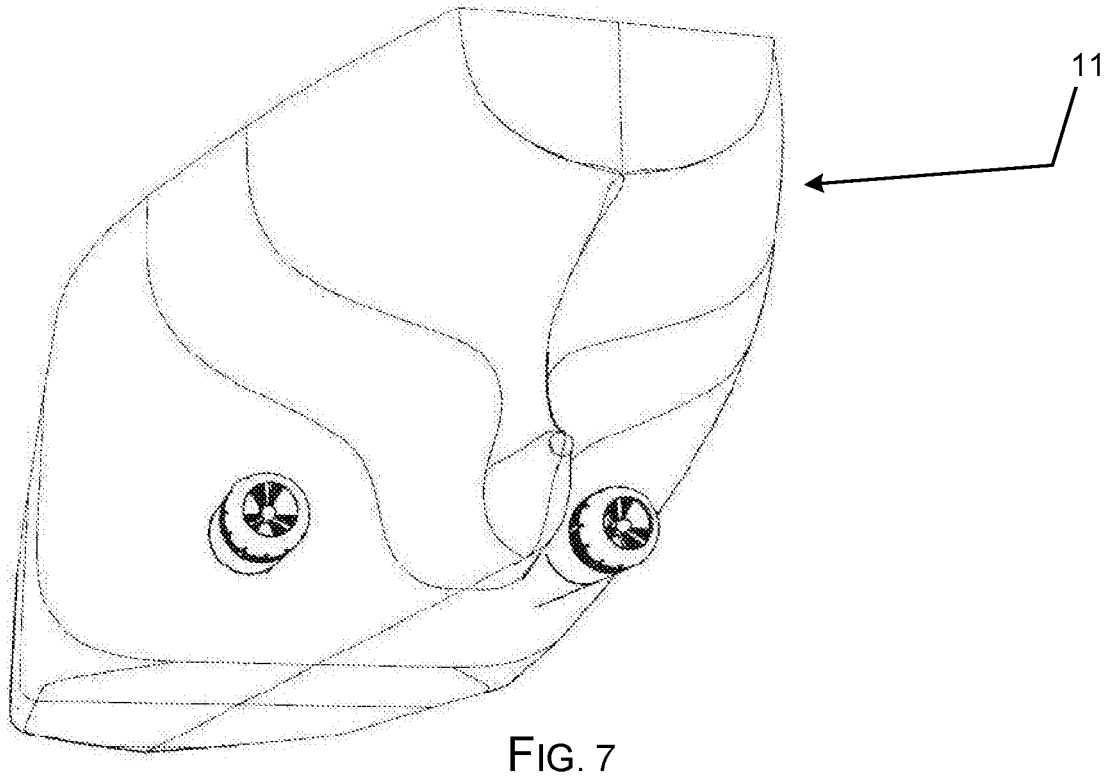
FIG. 7 is a perspective view of a marine vessel having the marine thruster apparatus of FIG. 1 attached thereto.

In FIG. 7, an embodiment of a water vessel 11 is shown having two marine thrusters attached thereon.

Figure 8:
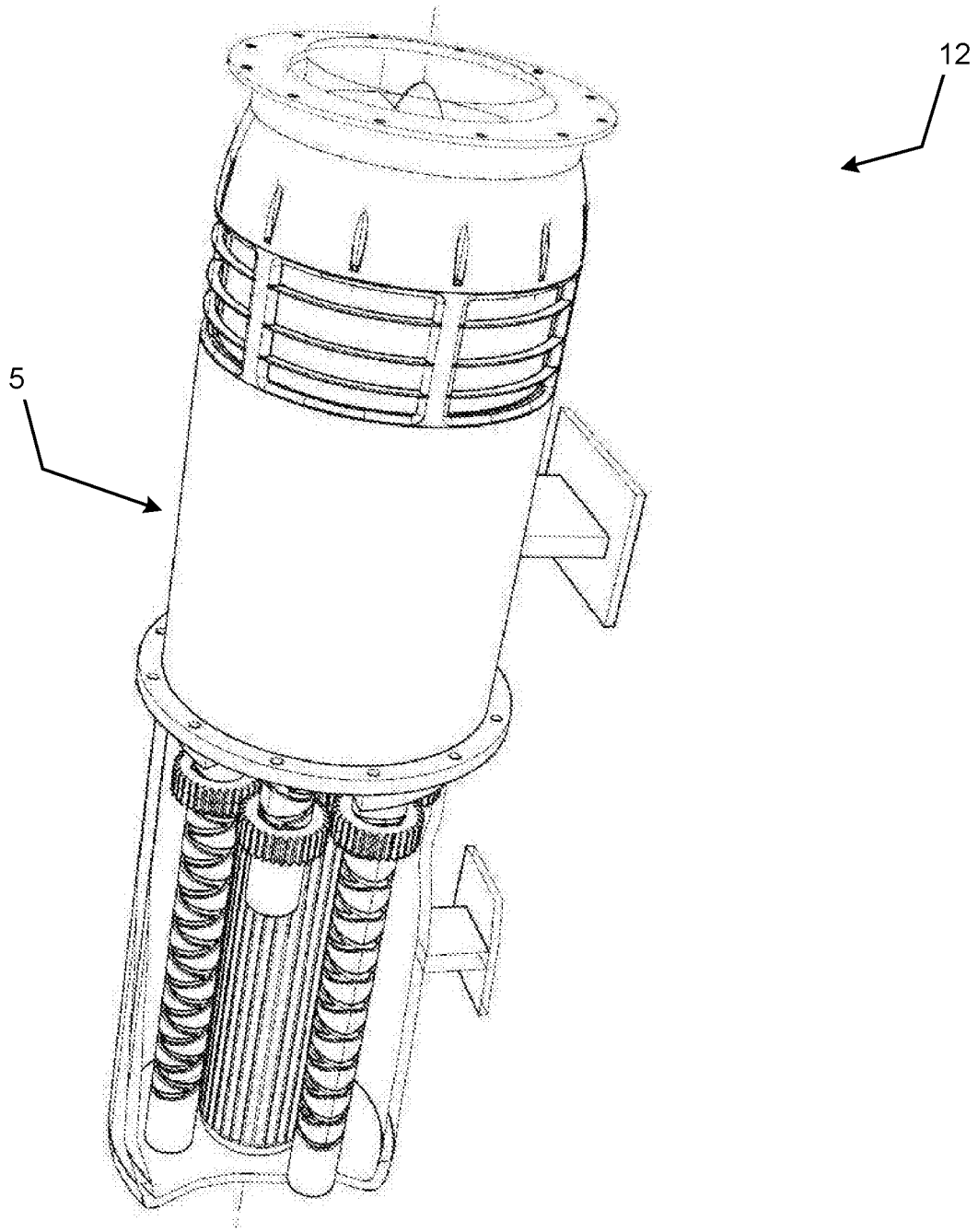
FIG. 8 is a side view of a PD pump in accordance with a preferred embodiment of the present application.
Figure 9:
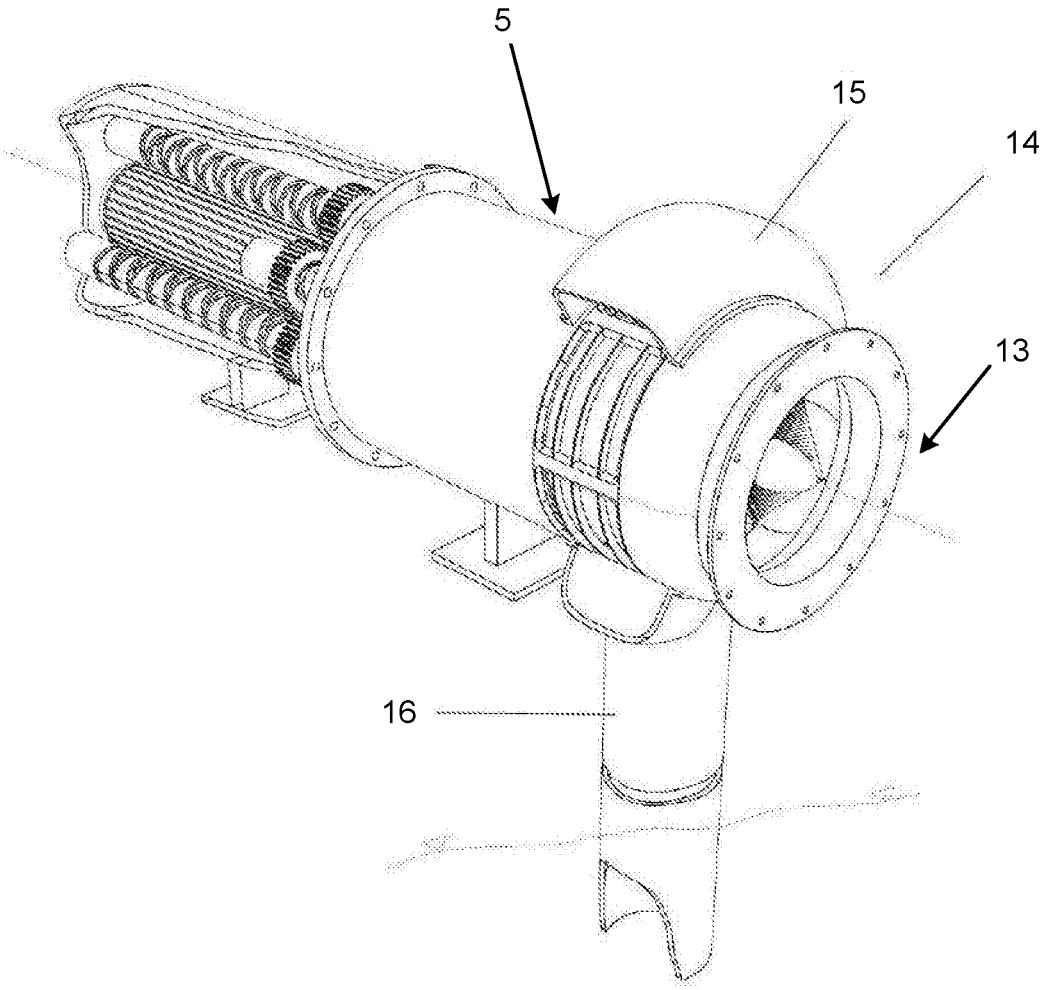
FIG. 9 is the pump of FIG. 8 engaged with a donut-inlet.
Figure 10:
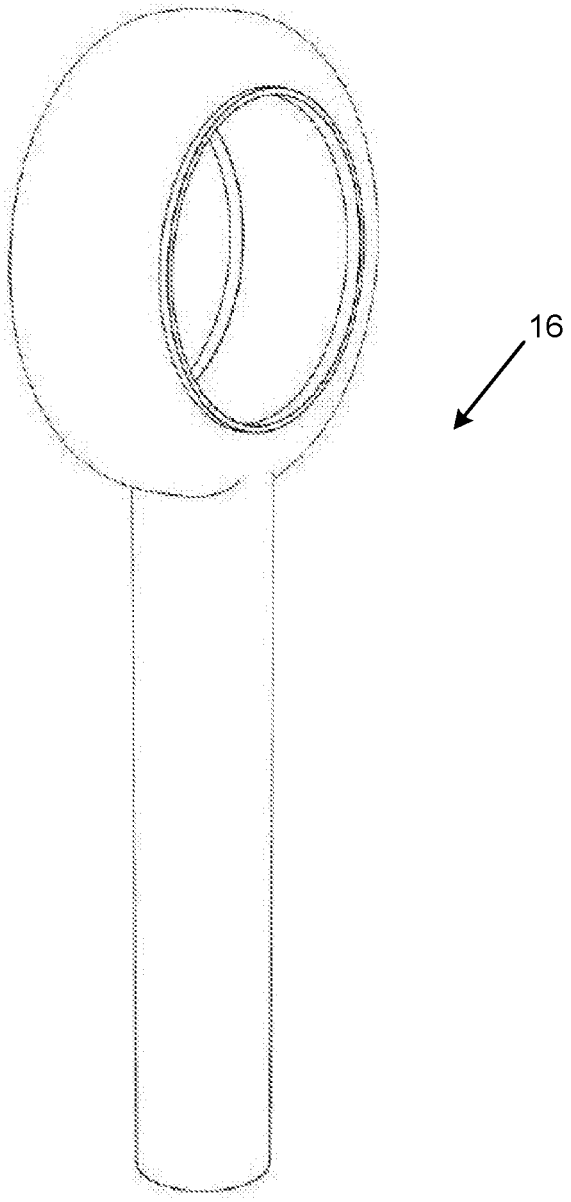
FIG. 10 is a perspective view of the donut inlet of FIG. 9.

Referring to FIG. 8 and FIG. 9, another embodiment of the present invention is shown, wherein a positive displacement pump 12 of great capacity, which includes the above-mentioned cylinder body 5, two sets of impulsive water jet mechanisms 8*a* and 8*b*, and an inner-ring rotary valve, 3. The embodiment is fixed on an installation foundation, and the nozzle exit 13 is reshaped to be a flange as shown in FIG. 9. The flange is then connected to a conducting pipe (not shown in the figure) to where water shall be pumped to. Its structure and working principle is similar to the embodiment used as a marine vessel thruster.

In one embodiment a donut-inlet device 14 envelops in watertight fashion the valve side openings 34 and is fixed on the outer casing of the cylinder body, 5 and the nozzle, 2 with screws. Further, said donut-inlet is composed of a donut shell 15 and an inlet tube 16 that leads to water source.

This embodiment has a self-priming capability as long as the inlet tube, 10 reaches is the water source to be pumped. Water will be pumped out by a repeated operation of the aforementioned two sets of the impulsive water jet mechanisms.

The embodiments of the present invention have been described above with reference to the accompanying drawings and embodiments, and the structures provided in the embodiments do not constitute limitations to the present invention. Those skilled in the art can make adjustments according to requirements, within the scope of the appended claims. Various changes or modifications are made within the scope of protection.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A marine thruster, comprising:

a cylinder body with a front opening and a rear opening;

one or more radial baffles positioned within an interior of the cylinder body and configured to separate the interior into a plurality of equally divided water chambers;

wherein said radial baffles penetrate to a front end of said cylinder body and extend out of a rear end of said cylinder body;

a plurality of pistons, each of the plurality of pistons positioned within a corresponding one of the equally divided water chambers;

an inner-ring rotary valve engaged with the cylinder and configured to allow for side intake of water and the separation of each of the equally divided water chambers into a dry section and a wet section by each of the plurality of pistons, the inner-ring rotary valve having:

one or more blockages;

one or more openings; and one or more side openings to open into one or more of the plurality of equally divided water chambers;

wherein the one or more blockages block one or more of the plurality of equally divided water chambers and the one or more openings open one or more of the plurality of equally divided water chambers to discharge water; and a nozzle secured on the cylinder body;

wherein the plurality of pistons are configured to engage with a power source, the power source providing axial reciprocating motion; and wherein the plurality of pistons push water through the plurality of equally divided water chambers.

2. The marine thruster of claim 1, wherein each of the plurality of pistons comprises: a ball-screw attached to a piston head.

3. The marine thruster of claim 1, further comprising:

a grid shell configured to engage around an outer surface of the inner-ring rotary valve and configured to connect to the cylinder and a nozzle by one or more screws.

4. The marine thruster of claim 1, wherein the plurality of pistons comprises:

a first set of pistons; and a second set of pistons;

wherein the first set of pistons and second set of pistons are in alternate positioning within the plurality of equally divided water chambers.

5. The marine thruster of claim 1, wherein each of the plurality of equally divided water chambers are fan-shaped columns.

6. A pump, comprising:

a cylinder with a front opening and a rear opening;

one or more radial baffles positioned within an interior of the cylinder and configured to separate the interior into a plurality of equally divided water chambers;

a plurality of pistons, each of the plurality of pistons positioned within a corresponding one of the equally divided water chambers;

an inner ring rotary valve engaged with the cylinder and configured to allow for side intake of water and the separation of each of the equally divided water chambers into a dry section and a wet section by each of the plurality of pistons, the inner-ring rotary valve having:

one or more blockages;

one or more openings; and one or more side openings to open into one or more of the plurality of equally divided water chambers;

wherein the one or more blockages block one or more of the plurality of equally divided water chambers and the one or more openings open one or more of the plurality of equally divided water chambers to discharge water; and a flange shaped nozzle engaged with the cylinder;

wherein the plurality of pistons are configured to engage with a power source, the power source providing axial reciprocating motion; and wherein the plurality of pistons push water through the plurality of equally divided water chambers.

7. The pump of claim 6, wherein each of the plurality of pistons comprises: a ball-screw attached to a piston head.

8. The pump of claim 6, further comprising:

a grid shell configured to engage around an outer surface of the inner ring rotary valve and configured to connect to the cylinder and a nozzle by one or more screws.

9. The pump of claim 6, wherein the plurality of pistons comprises:

a first set of pistons; and a second set of pistons;

wherein the first set of pistons and second set of pistons are in alternate positioning within the plurality of equally divided water chambers.

10. The pump of claim 6, wherein each of the plurality of equally divided water chambers are fan shaped columns.

11. The pump of claim 6, further comprising:

a donut inlet device having a donut shell configured to envelop an exterior of the inner ring rotary valve; and an inlet tube attached to a water source an integral with the donut inlet.

* * * * *